US011337564B1

(12) United States Patent
Kemp

(10) Patent No.: US 11,337,564 B1
(45) Date of Patent: May 24, 2022

(54) MULTIFUNCTIONAL TOOL

(71) Applicant: David Kemp, Chicago, IL (US)

(72) Inventor: David Kemp, Chicago, IL (US)

( * ) Notice: Subject to any disclaimer, the term of this patent is extended or adjusted under 35 U.S.C. 154(b) by 0 days.

(21) Appl. No.: 17/316,172

(22) Filed: May 10, 2021

(51) Int. Cl.

| | |
|---|---|
| ***A47K 7/02*** | (2006.01) |
| ***A47L 13/42*** | (2006.01) |
| ***B08B 1/00*** | (2006.01) |
| ***A47K 7/04*** | (2006.01) |
| *B25G 1/06* | (2006.01) |
| *B25G 3/00* | (2006.01) |
| *B25G 1/10* | (2006.01) |
| *B25G 1/04* | (2006.01) |

(52) U.S. Cl.
CPC ..... *A47K 7/028* (2013.01); *A47K 7/02* (2013.01); *A47K 7/04* (2013.01); *A47K 7/043* (2013.01); *A47L 13/42* (2013.01); *B08B 1/00* (2013.01); *A47K 7/022* (2013.01); *A47K 7/026* (2013.01); *B25G 1/04* (2013.01); *B25G 1/06* (2013.01); *B25G 1/102* (2013.01); *B25G 3/00* (2013.01)

(58) Field of Classification Search
CPC ..... A47K 7/02; A47K 7/022; A47K 7/026; A47K 7/028; A47K 7/04; A47K 7/043; A47L 13/42; B08B 1/00; B25G 1/06; B25G 1/066; B25G 1/102; B25G 1/08; B25G 3/38
USPC ..... 601/137; 15/239, 244.2
See application file for complete search history.

(56) References Cited

U.S. PATENT DOCUMENTS

| | | | | |
|---|---|---|---|---|
| 2,639,930 | A | 5/1953 | Thornton | |
| 2,658,221 | A * | 11/1953 | Nicoli | A47L 4/02 15/244.1 |
| D391,706 | S | 3/1998 | Malcolm | |
| 5,842,488 | A * | 12/1998 | Belleau | B25G 1/06 132/320 |
| 5,904,661 | A | 5/1999 | Bonz et al. | |
| 5,913,739 | A | 6/1999 | Brenneisen | |
| 6,026,535 | A * | 2/2000 | Lankowski | A45D 34/04 15/244.2 |
| 6,053,076 | A * | 4/2000 | Barnes | B25G 1/063 403/103 |
| 6,308,599 | B1 * | 10/2001 | Fu-Hui | B25G 1/066 81/177.4 |
| D461,009 | S | 7/2002 | Viner | |
| 6,883,994 | B1 | 4/2005 | Grogg | |
| 6,994,680 | B1 | 2/2006 | Aponte | |
| 8,020,716 | B2 | 9/2011 | Vitale | |
| 9,168,196 | B2 | 10/2015 | Dagan | |

(Continued)

FOREIGN PATENT DOCUMENTS

CA 2257114 A1 6/2000

*Primary Examiner* — Tuan N Nguyen
(74) *Attorney, Agent, or Firm* — Foley & Lardner LLP

(57) ABSTRACT

A tool includes a handle, and arm, a pivotable coupler, and an implement. The handle has a first end and an opposing second end. The arm has a third end and an opposing fourth end. The pivotable coupler couples the opposing second end of the handle to the third end of the arm. The handle and the arm are pivotable relative to each other about the pivotable coupler between a closed orientation and an open orientation. The handle and the arm extend in a substantially same direction when arranged in the closed orientation. The arm extends at an angle from the handle when arranged in the open orientation. The implement is coupled to the opposing fourth end of the arm.

14 Claims, 7 Drawing Sheets

(56) References Cited

U.S. PATENT DOCUMENTS

| | | | |
|---|---|---|---|
| 10,279,462 | B1 | 5/2019 | Kemp |
| 10,442,072 | B2 | 10/2019 | Kemp |
| 2004/0163215 | A1 | 8/2004 | Wang |
| 2007/0093736 | A1 | 4/2007 | Hebert |
| 2007/0287938 | A1 | 12/2007 | Shields |
| 2016/0114477 | A1 | 4/2016 | Saccoccio et al. |
| 2017/0239531 | A1 | 8/2017 | Olivieri |

* cited by examiner

MULTIFUNCTIONAL TOOL

BACKGROUND

Cleaning devices are useful for applying soaps, lotions, and other cleaners and cosmetic preparations to areas that are normally inaccessible or difficult to reach (e.g., a person's back). Conventional cleaning devices typically use a single piece or fixed construction that requires the user to fully extend at least a portion of the user's arms in order to access otherwise inaccessible areas of the user's body. Disabled individuals or individuals with mobility issues have increased difficulty accessing certain areas of their body and often have difficulty extending portions of their arms to use conventional cleaning devices. Use of conventional cleaning devices often lead to strain on the user's shoulder. Some conventional cleaning devices are limited by engineering design, with the usefulness of the device being constrained by a permanently affixed utility head on the utility end of the device. Furthermore, conventional single piece or fixed construction cleaning devices can be difficult to transport and store as their single piece or fixed construction design is not space efficient.

SUMMARY

One embodiment relates to a tool. The tool includes a handle, an arm, a pivotable coupler, and an implement. The handle has a first end and an opposing second end. The arm has a third end and an opposing fourth end. The pivotable coupler couples the opposing second end of the handle to the third end of the arm. The handle and the arm are pivotable relative to each other about the pivotable coupler between a closed orientation and an open orientation. The handle and the arm extend in a substantially same direction when arranged in the closed orientation. The arm extends at an angle from the handle when arranged in the open orientation. The implement is coupled to the opposing fourth end of the arm.

Another embodiment relates to a kit. The kit comprising a tool, a first implement, and a second implement. The tool comprising a handle, an arm, a pivotable coupler, and an implement mount. The handle has a first end and an opposing second end. The arm has a third end and an opposing fourth end. The pivotable coupler couples the opposing second end of the handle to the third end of the arm. The handle and the arm are pivotable relative to each other about the pivotable coupler between a closed orientation and an open orientation. The handle and the arm extend in a substantially same direction when arranged in the closed orientation. The arm extends at an angle from the handle when arranged in the open orientation. The implement mount is coupled to the opposing fourth end of the arm. The first implement is configured to detachably couple to the implement mount. The second implement is interchangeable with the first implement.

Yet another embodiment relates to a tool. The tool includes a handle, an arm, a pivotable coupler, and an implement. The handle has a first end and an opposing second end. The arm has a third end and an opposing fourth end. The pivotable coupler couples the opposing second end of the handle to the third end of the arm. The implement is coupled to the opposing fourth end of the arm. The handle and the arm are pivotable relative to each other about the pivotable coupler between a closed orientation and an open orientation. The handle and the arm extend in a substantially same direction when arranged in the closed orientation. The arm extends at an angle from the handle when arranged in the open orientation. The handle and the arm are configured to be selectively secured or held in at least one of the open orientation or the closed orientation.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

According to an exemplary embodiment, a multifunctional tool of the present disclosure allows a user to cleanse, scratch, massage, moisturize, heat treat, or reach areas of the user's body (e.g., a user's back, a user's foot, etc.) or areas around the user (e.g., high-to-reach areas, nooks and crannies, etc.) with significantly less stress or strain on the user's arms. For example, the multifunctional tool described herein may be held during use such that a portion of the user's arm from the shoulder to the elbow is substantially horizontal. In other examples, the multifunctional tool may be held from a handle at or near the user's eye level whereby a utility head of the multifunctional tool contacts an area of the user's body that may be otherwise difficult to access (e.g., the user's back). In this manner, the user is allowed to effectively perform the predetermined function without straining. This is particularly helpful for users with limited flexibility, limited mobility, or a disability that inhibits access to difficult areas of the user's body, such as the user's back. The utility head may be or include a scratcher head, a washcloth, a lotion applicator, a loofah, a bath pouf, a massager, a heater, a sponge, a light, a hook, a magnet, a shoe horn, a phone mount, a light bulb gripper, a duster head, a brush head, a broom head, a mop head, and/or still another suitable utility head.

Figure 2:
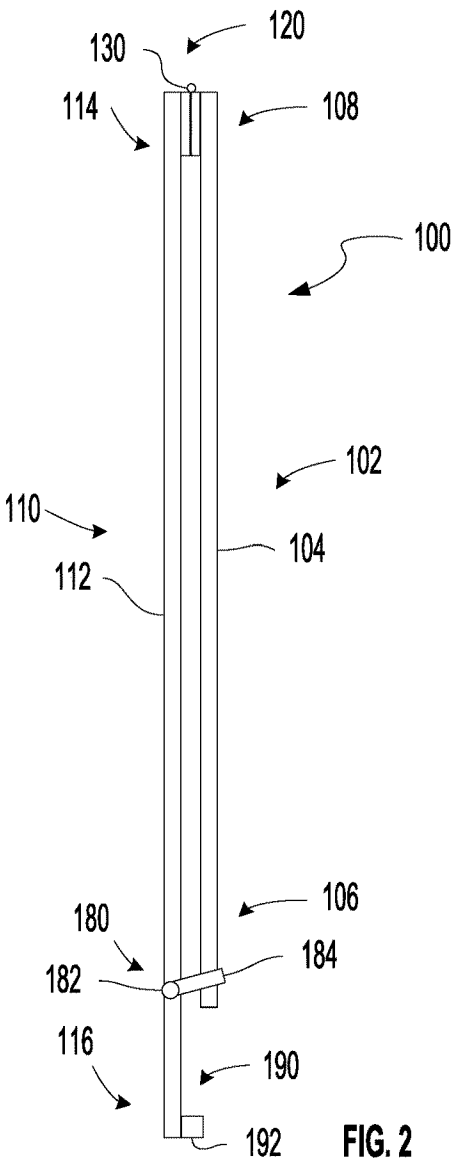
FIG. 2 is a side view of the multifunctional tool of FIG. 1 in a second orientation, according to an exemplary embodiment.
Figure 1:
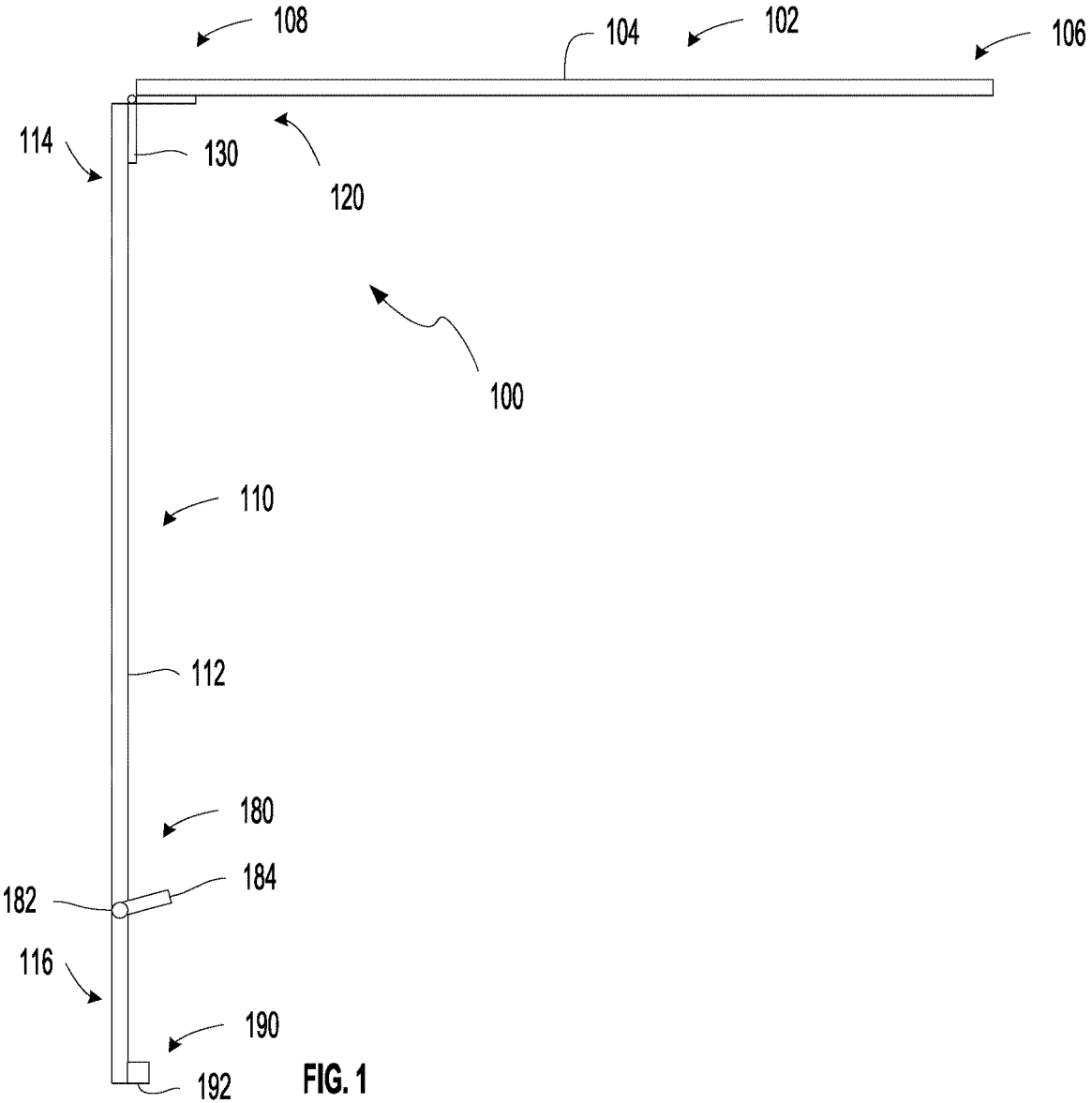
FIG. 1 is a side view of a multifunctional tool in a first orientation, according to an exemplary embodiment.

According to the exemplary embodiment shown in FIGS. 1 and 2, a tool or personal care device, shown as multifunctional tool 100, includes a first member or portion, shown as handle 102, a second member or portion, shown as arm 110, and a joint mechanism, shown as joint 120, coupling the arm 110 to the handle 102. According to an exemplary embodiment, the multifunctional tool 100 is configured to facilitate ergonomic and convenient access to areas that may otherwise require the user to strain to reach (e.g., the user's back, a terminal end of the user's leg, a user's foot, a high-to-reach area, nooks and crannies, etc.).

As shown in FIGS. 1 and 2, the handle 102 includes a first, elongated member, shown as handle shaft 104. The handle shaft 104 has a first end, shown as grip end 106, and an opposing second end, shown as pivot end 108. According to the exemplary embodiment shown in FIGS. 1 and 2, the handle shaft 104 has a fixed length. In another embodiment, the handle shaft 104 has an adjustable length. According to the exemplary embodiment shown in FIGS. 1 and 2, the handle shaft 104 has a straight or substantially straight profile. In another embodiment, the handle shaft 104 has a curved profile or is otherwise shaped to provide an ergonomic feeling to the user. In one embodiment, the handle shaft 104 is rigid or substantially rigid. In another embodiment, the handle shaft 104 is semi-rigid or at least partially flexible. In some embodiments, the handle 102 includes a handle grip (e.g., a taped grip, a friction fabric grip, a foam grip, etc.) that facilitates easier and secure handling of the multifunctional tool 100 by the user. In some embodiments, the grip end 106 of the handle shaft 104 is configured to perform a primary function and a secondary function. For example, the grip end 106 of the handle shaft 104 may be configured to function as both a handle grip and a shoe horn.

As shown in FIGS. 1 and 2, the arm 110 includes a second, elongated member, shown as arm shaft 112. The arm shaft 112 has a first end, shown as pivot end 114, and an opposing second end, shown as utility end 116. According to the exemplary embodiment shown in FIGS. 1 and 2, the arm shaft 112 has a fixed length. In another embodiment, the arm shaft 112 has an adjustable length. According to the exemplary embodiment shown in FIGS. 1 and 2, the arm shaft 112 has a straight or substantially straight profile. In another embodiment, the arm shaft 112 has a curved profile or is otherwise shaped to provide an ergonomic feeling to the user. In one embodiment, the arm shaft 112 is rigid or substantially rigid. In another embodiment, the arm shaft 112 is semi-rigid or at least partially flexible. In one embodiment, the arm shaft 112 is longer than the handle shaft 104. In another embodiment, the handle shaft 104 is longer than the arm shaft 112. In other embodiments, the handle shaft 104 and the arm shaft 112 have the same or substantially the same length. While the handle shaft 104 and the arm shaft 112 are shown to have a similar shape and profile, in other embodiments, the handle shaft 104 and the arm shaft 112 have different shapes or profiles relative to one another.

As shown in FIGS. 1 and 2, the joint 120 includes a pivoting coupler or folding bracket, shown as hinge 130, coupled to the pivot end 108 of the handle shaft 104 and the pivot end 114 of the arm shaft 112, thereby pivotably coupling the arm 110 to the handle 102. According to the exemplary embodiment shown in FIGS. 1 and 2, the multifunctional tool 100 is selectively reconfigurable about the hinge 130 between a first, closed position or orientation (as shown in FIG. 2) and a second, open position or orientation (as shown in FIG. 1). In the open position or orientation, the arm 110 extends from the handle 102 at an angle. The angle may range anywhere from 1 degree to 180 degrees. In some embodiments, the joint 120 includes a locking mechanism, a ratcheting mechanism, a biasing element and a retaining element, and/or another mechanism that facilitates a user selectively locking or holding the arm 110 at a desired or preset angle when arranged in the open position or orientation, as described in more detail herein. As shown in FIG. 2, the handle 102 and the arm 110 are substantially parallel and extend in the substantially same direction when the multifunctional tool 100 is arranged in the closed position or orientation. The hinge 130 of the joint 120 may use any type of pivot or pivotable coupling mechanism (e.g., butt hinge, ball bearing butt hinge, spring-loaded butt hinge, etc.) that is configured to pivotably couple the handle 102 and the arm 110 together. By way of example, the hinge 130 may include a first leaf secured to the pivot end 114 of the arm shaft 112 and a second leaf secured to pivot end 108 of the handle shaft 104. The leaves may have knuckles that are joined together by a pin, which facilitates rotation of the arm 110 relative to the handle 102 about a longitudinal axis of the pin.

As shown in FIGS. 1 and 2, the multifunctional tool 100 includes a securing mechanism, shown as latch assembly 180. The latch assembly 180 is configured to selectively and releasably secure the multifunctional tool 100 in the closed position or orientation with the grip end 106 of the handle 102 proximate the utility end 116 of the arm 110. The latch assembly 180 includes a pivotable coupler (e.g., a pin, a pivot shaft, etc.), shown as pivot 182, coupled along the arm shaft 112 proximate the utility end 116 thereof and a latching arm, shown as latch 184, coupled to the pivot 182. According to an exemplary embodiment, the latch 184 is configured to rotate about the pivot 182 such that the latch 184 can selectively extend around the grip end 106 of the handle shaft 104 in a securing position. In another embodiment, the pivot 182 is coupled along the handle shaft 104 (see, e.g., FIGS. 10-12) and the latch 184 is configured to selectively extend around the arm shaft 112 in a securing position. The latch assembly 180 may, therefore, be mounted, anchored, or fixedly attached to either the handle 102 or the arm 110. In some embodiments, the latch assembly 180 is biased (e.g., with a spring element, a torsional spring, etc.) toward the securing position. For example, the latch assembly 180 may be biased towards a position or orientation substantially perpendicular to the shaft to which the latch assembly 180 is mounted (e.g., perpendicular to the handle shaft 104). The latch assembly 180 may be manually actuated by the user or may be selectively actuatable (e.g., from a securing or engaged position to a non-securing or disengaged position) via a button or switch disposed along the multifunctional tool 100 (e.g., the arm shaft 112, the handle shaft 104, etc.).

In other embodiments, the securing mechanism of the multifunctional tool 100 does not include the latch assembly 180, but instead the securing mechanism is otherwise configured. By way of example, the securing mechanism may be or include a strap, a clip mechanism, a hook latch (e.g., a spring tension hook latch, a swinging hook latch, etc.), and/or another suitable mechanism that facilitates selectively holding the multifunctional tool 100 in the closed position or orientation. In an alternative embodiment, the multifunctional tool 100 does not include the securing mechanism. In such an embodiment, the joint 120 may include a locking feature or mechanism (e.g., a self-locking feature, a manual locking feature, etc.).

As shown in FIGS. 1 and 2, the multifunctional tool 100 includes an implement mounting element, shown as utility mount 190, positioned proximate the utility end 116 of the arm shaft 112. The utility mount 190 may be mounted to any exterior surface or combination of surfaces of the arm shaft 112 proximate the utility end 116. As shown in FIGS. 1 and 2, the utility mount 190 includes a utility interface, shown as utility coupler 192. According to an exemplary embodiment, the utility coupler 192 is configured to releasably and interchangeably secure various utility heads to the arm shaft 112 proximate the utility end 116 thereof. In various embodiments, the utility coupler 192 includes a nut/bolt configuration, magnets, a hook and loop fastener, threading, adhesive tape, suction cups, snap-on or snap-fit interfaces, sliding grooves, and/or another suitable coupler design.

Figure 3:
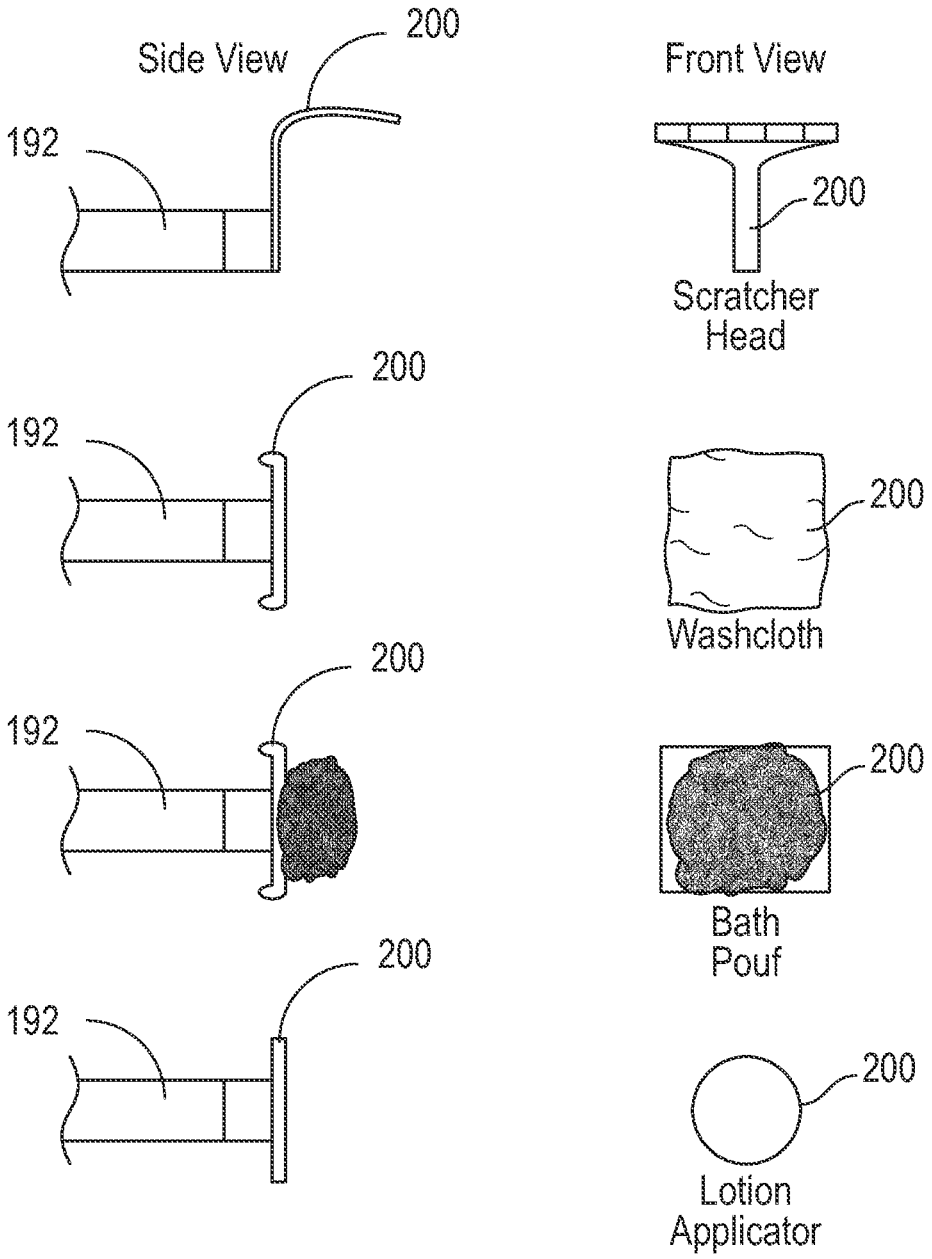
FIG. 3 illustrates various utility heads attachable to the multifunctional tool of FIG. 1, according to various exemplary embodiments.
Figure 5:
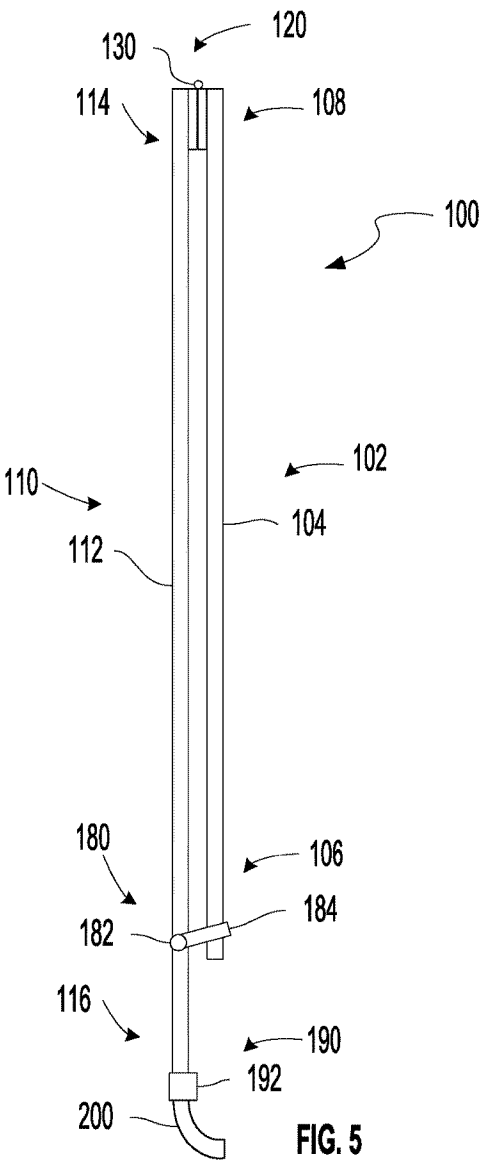
FIG. 5 is a side view of the multifunctional tool of FIG. 4 in the second orientation, according to an exemplary embodiment.
Figure 4:
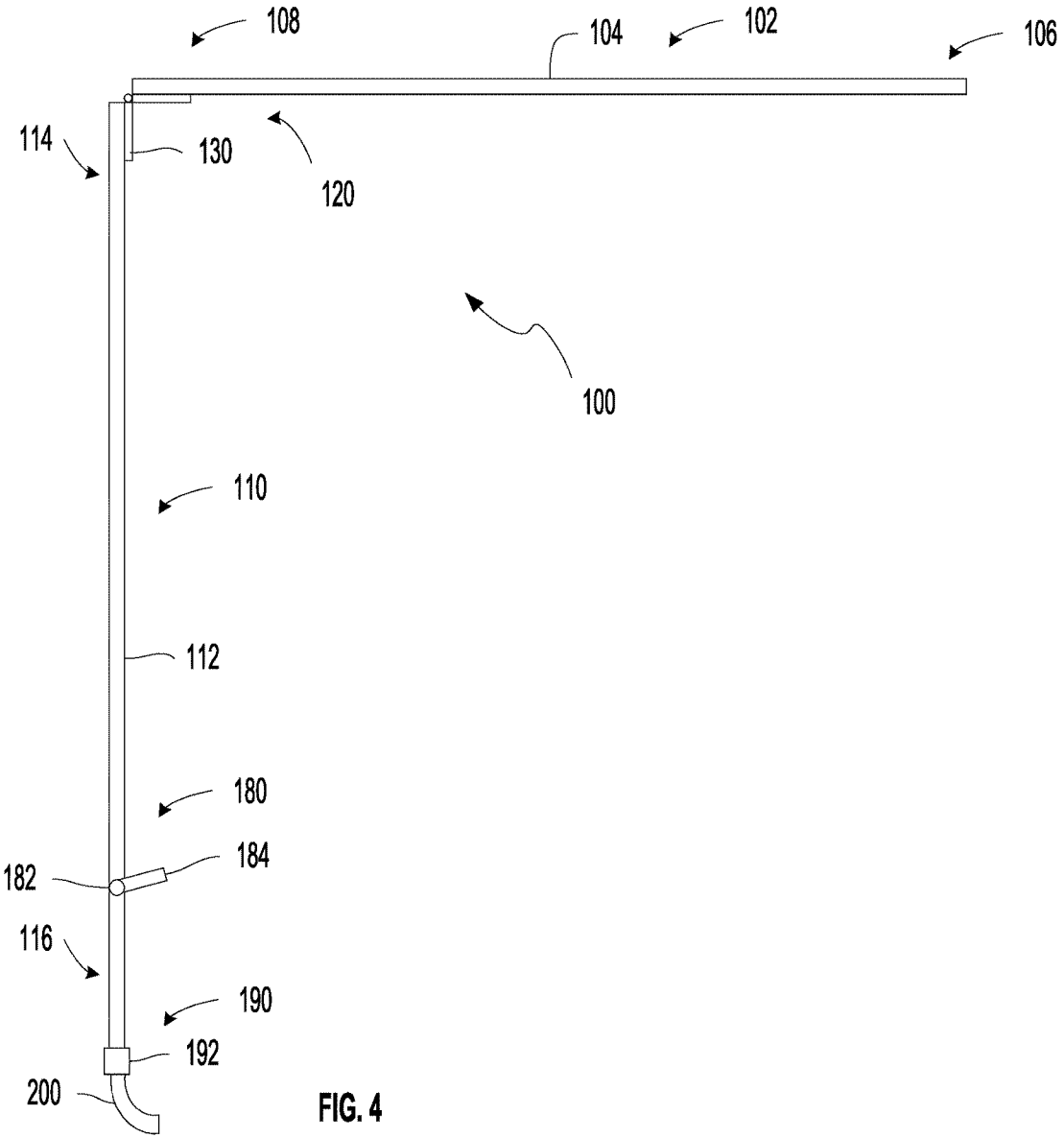
FIG. 4 is a side view of the multifunctional tool of FIG. 1 with a respective utility head of FIG. 3 attached thereto and in the first orientation, according to an exemplary embodiment.

As shown in FIGS. 3-5, attachments or implements (e.g., personal care attachments, utility attachments, applicators, applicator heads, etc.), shown as utility heads 200, are selectively and interchangeably attachable to the utility coupler 192. The utility heads 200 may, therefore, be selectively attached to the multifunctional tool 100 as desired by the user. In some embodiments, the utility coupler 192 includes a pivoting mechanism (e.g., a swivel, a bearing, a hinge, etc.) that facilitates rotating or pivoting the utility heads 200 about or relative to the utility end 116 of the arm shaft 112 (e.g., to allow for flexibility in accessing hard-to-reach portions of the user, etc.). By way of example, the utility coupler 192 may be or include a ball-cup socket whereby a ball bearing is inserted into a receiving cup that allows for 360 degree rotation of the utility head 200 relative to the utility end 116. In another embodiment, a respective one of the utility heads 200 is fixed to and not detachable from the utility end 116 of the arm shaft 112 (e.g., the arm shaft 112 and the respective utility head 200 are integrally formed, etc.). As shown in FIG. 3, the utility heads 200 include a scratcher head attachment, a washcloth attachment, a bath pouf attachment, and a lotion applicator attachment. In other embodiments, additional or alternative utility heads 200 are useable with the multifunctional tool 100. By way of example, the utility heads 200 may additionally or alternatively include a loofa attachment, a sponge attachment, a massager attachment, a light attachment, a hook attachment, a magnet attachment, a shoe horn attachment, a phone mount attachment, a light bulb gripper attachment, a duster head attachment, a brush head attachment, a broom head attachment, a mop head attachment, and/or still other suitable attachments. In some embodiments, the multifunctional tool 100 is provided with two or more interchangeable utility heads 200 as a kit.

As shown in FIG. 5 the multifunctional tool 100 has a respective one of the utility heads 200 (i.e., the scratcher head attachment) coupled thereto and is arranged in the closed position or orientation. According to the exemplary embodiment shown in FIG. 5, the utility mount 190 and, therefore, the utility heads 200 are positioned below the grip end 106 of the handle shaft 104. Such an arrangement may facilitate interchanging the utility heads 200 when the multifunctional tool 100 is arranged in the closed position or orientation. In other embodiments, at least a portion of the utility head 200 is recessed within the grip end 106 of the handle shaft 104 when the multifunctional tool 100 is arranged in the closed position or orientation. For example, the grip end 106 of the handle shaft 104 may be shaped to at least partially surround (e.g. cup, nest with, etc.) the utility head 200 in the closed position or orientation.

According to an exemplary embodiment, each component of the multifunctional tool 100 is fabricated with lightweight and durable materials including, but not limited to, metals (e.g., titanium, aluminum, magnesium, etc.) and their alloys, one or more variety of woods, carbon fiber, polymers and their blends (e.g., polyamide, polystyrene, polyvinylchloride, polymethylmethacrylate, polycarbonate, polyoxymethylene, polyester, polyphenylene sulfide, polyethersulfone, polyalkyleneisophthalate, polyarylate, polyetheretherketone, polyetherimide, polyimide, polytetrafluoroethylene, liquid crystalline polymers, etc.), nanostructured ceramics, combinations thereof, and/or still other suitable materials.

The handle shaft 104 and the arm shaft 112 may have any geometry or material composition such that the handle shaft 104 and the arm shaft 112 are able to support a force supplied by the user during normal use without failure (e.g., plastic deformation, fracture, etc.). The handle shaft 104 and the arm shaft 112 may be manufactured from the same material or from different materials. According to an exemplary embodiment, the handle shaft 104 and/or the arm shaft 112 have a geometry or shape that facilitates ergonomic access to areas of the user's body that would otherwise be difficult to access without the multifunctional tool 100. For example, the handle shaft 104 may be cylindrical proximate the grip end 106 to facilitate ergonomic handling by the user. As another example, the pivot end 108 of the handle shaft 104 and/or the pivot end 114 of the arm shaft 112 may have a flat portion or flat shape that facilitates attaching the joint 120 thereto. The handle shaft 104 and the arm shaft 112 may have different or the same cross-sectional geometry. The cross-sectional geometry of the handle shaft 104 and/or the arm shaft 112 may vary along the lengths thereof. For example, the handle shaft 104 may have a cross-sectional shape near the grip end 106 that is different than the cross-section shape near the pivot end 108 and may have a transitional intermediate cross-sectional geometry therebetween (e.g., may transition from cylindrical or elliptical to rectangular, etc.). The properties of the handle shaft 104 and/or the arm shaft 112 may be isotropic or anisotropic between the ends thereof. For example, the handle shaft 104 may comprise anisotropic material (e.g., wood).

According to the exemplary embodiment shown in FIGS. 6-9, the joint 120 of the multifunctional tool 100 includes a selectively fixable mechanism (e.g., lever-lock position hinge, set-angle position hinge, etc.), shown as locking mechanism 140. The locking mechanism 140 may be a variation of the hinge 130 or used in combination with the hinge 130. By way of example, the locking mechanism 140 may replace the traditional pin of the hinge 130 with a threaded bolt/pin with a retainer (e.g., a retaining fastener, a securing nut, a wing nut, a securing mechanism, etc.) at one end thereof. The retainer is configured to increase friction between the knuckles of the hinge leaves upon tightening of the securing nut to thereby lock the hinge in a desired position. According to an exemplary embodiment, a wear-resistant friction material may be placed between the contact surfaces of the knuckles to increase the friction and life of the hinge. For example, the joint may include washers (e.g., nylon washers) interspaced between the knuckles of the modified (e.g., locking) hinge.

Figure 7:
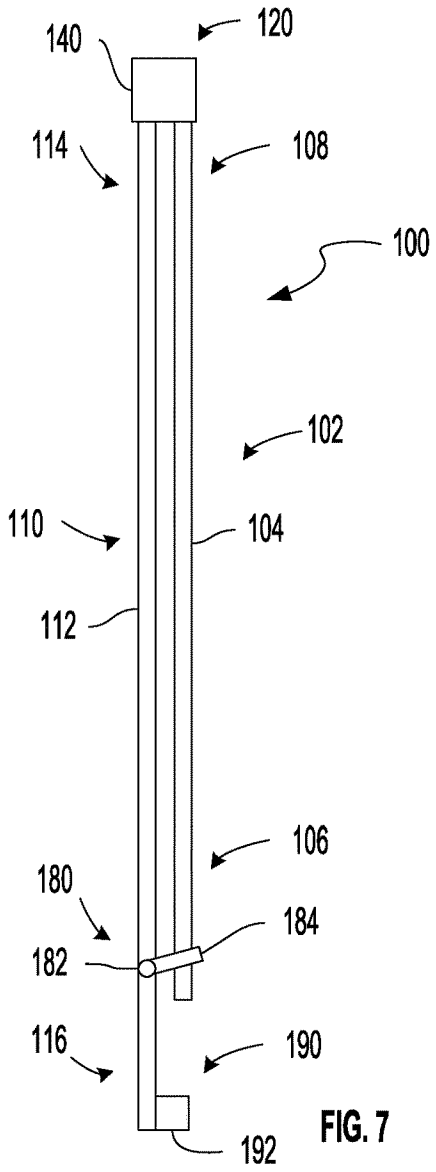
FIG. 7 is a side view of the multifunctional tool of FIG. 6 in the second orientation, according to an exemplary embodiment.
Figure 6:
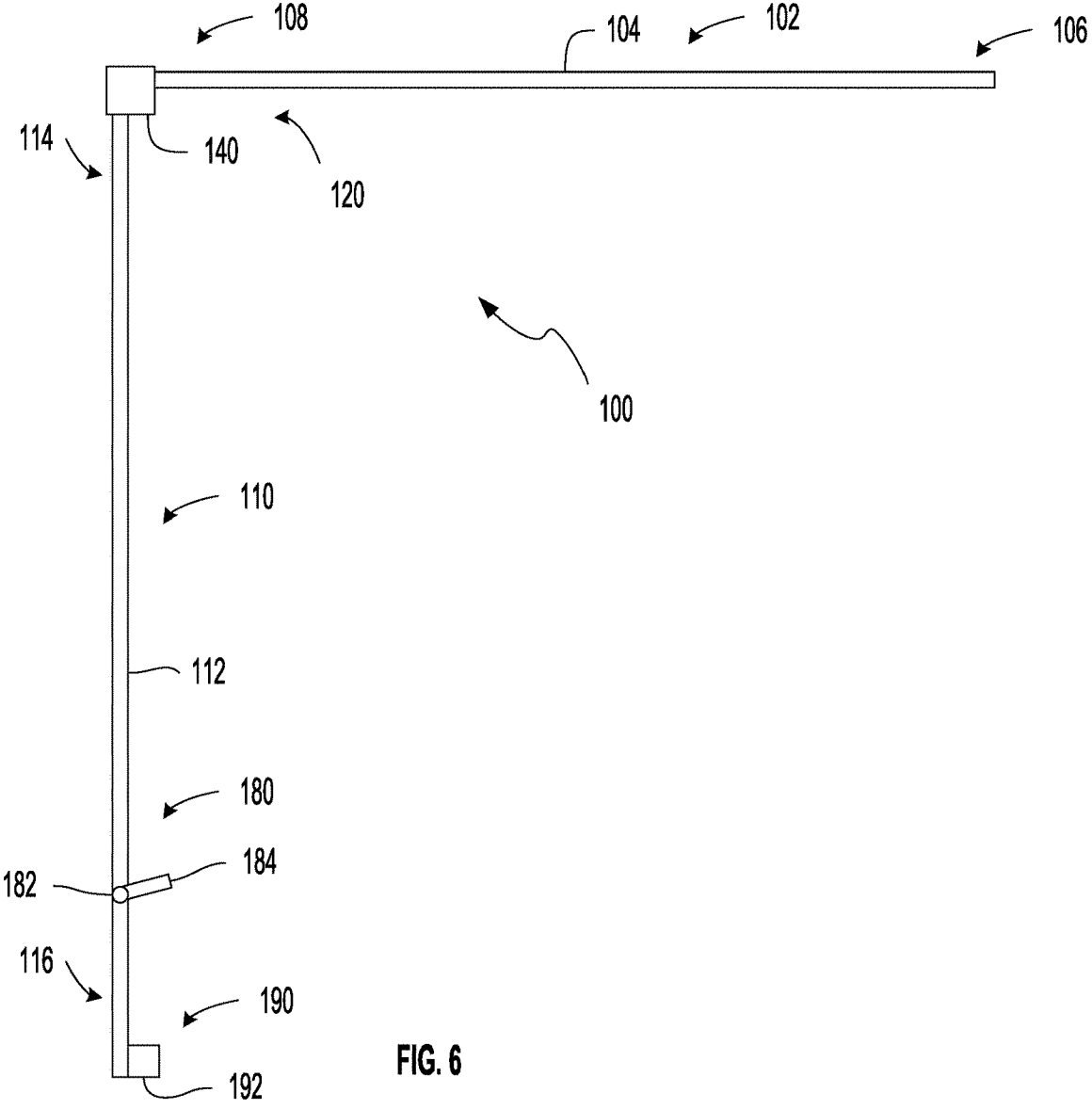
FIG. 6 is a side view of a multifunctional tool in the first orientation, according to another exemplary embodiment.
Figure 9:
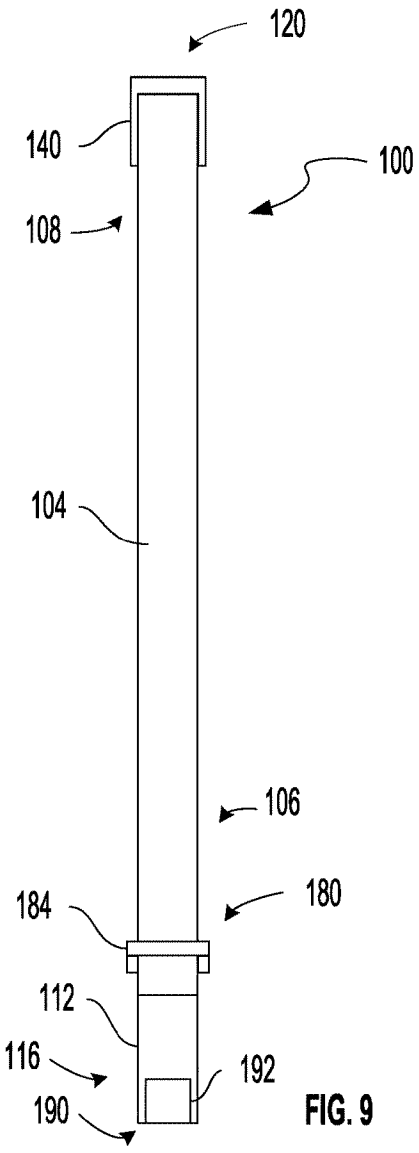
FIG. 9 is a front view of the multifunctional tool of FIG. 6 in the second orientation, according to an exemplary embodiment.

As shown in FIGS. 7 and 9, the multifunctional tool 100 is in the closed position or orientation and secured by the latch assembly 180. In some embodiments, the locking mechanism 140 is capable of securing the multifunctional tool 100 in the closed position or orientation independent of the latch assembly 180. In such embodiments, the multifunctional tool 100 may not include the latch assembly 180, but the function of the latch assembly 180 may be performed by the locking mechanism 140 (i.e., a securing mechanism is integrated into the joint 120/the hinge 130). In other embodiments, the locking mechanism 140 can be used in conjunction with the latch assembly 180 to secure the multifunctional tool 100 in the closed position or orientation.

Figure 8:
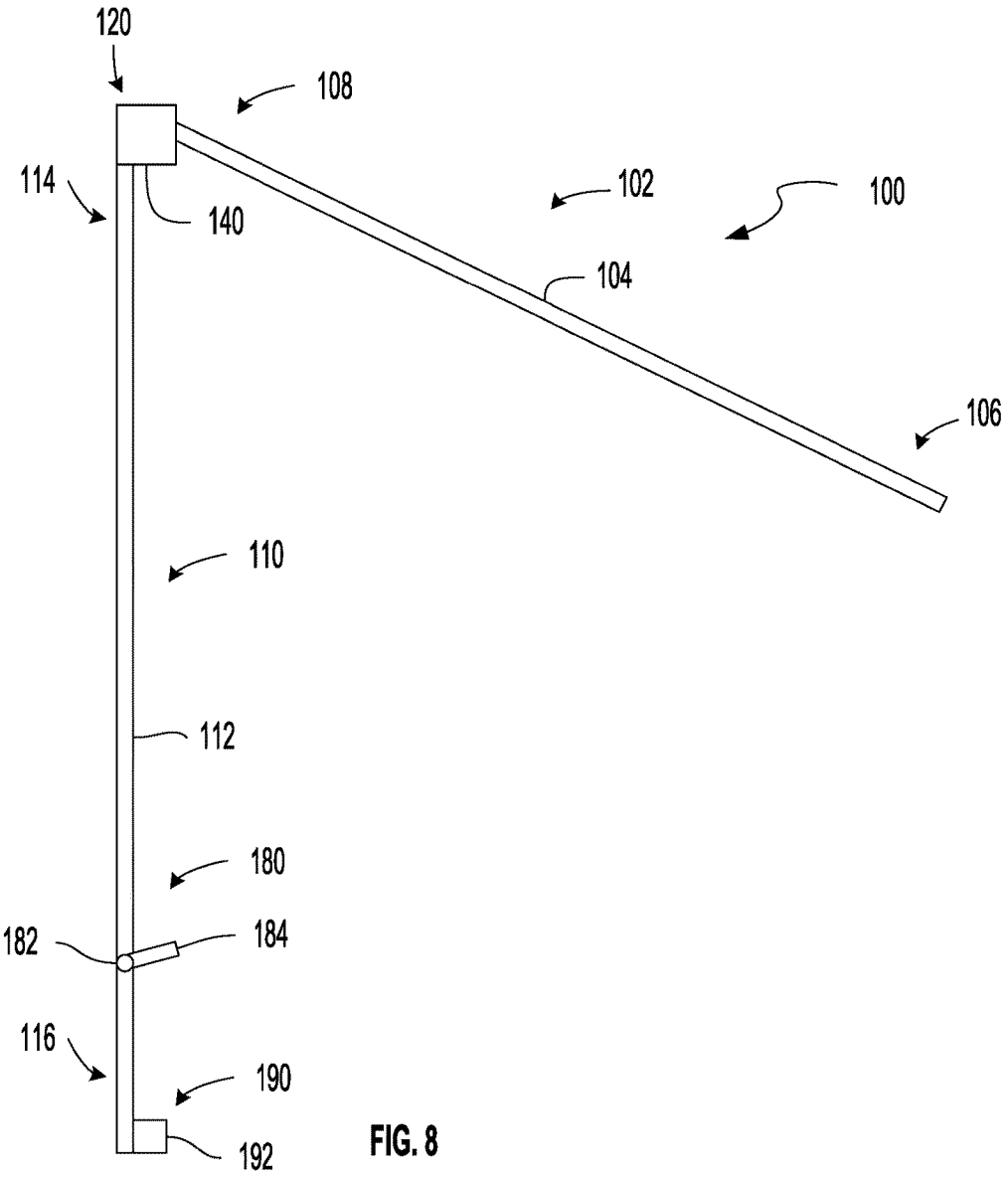
FIG. 8 is a side view of the multifunctional tool of FIG. 6 in a third orientation, according to an exemplary embodiment.

As shown in FIG. 8, the locking mechanism 140 is configured to facilitate locking the multifunctional tool 100 at various different opening angles, as desired by the user. By way of example, the opening angle (e.g., open position) may be greater than, less than, or equal to 90 degrees. By way of another example, the locking mechanism 140 may be configured to facilitate locking the multifunctional tool 100 at any position or angle between the closed position and the fully-open position (e.g., 0 to 180 degrees, 0 to 90 degrees, 0 to 135 degrees, etc.).

Figure 10:
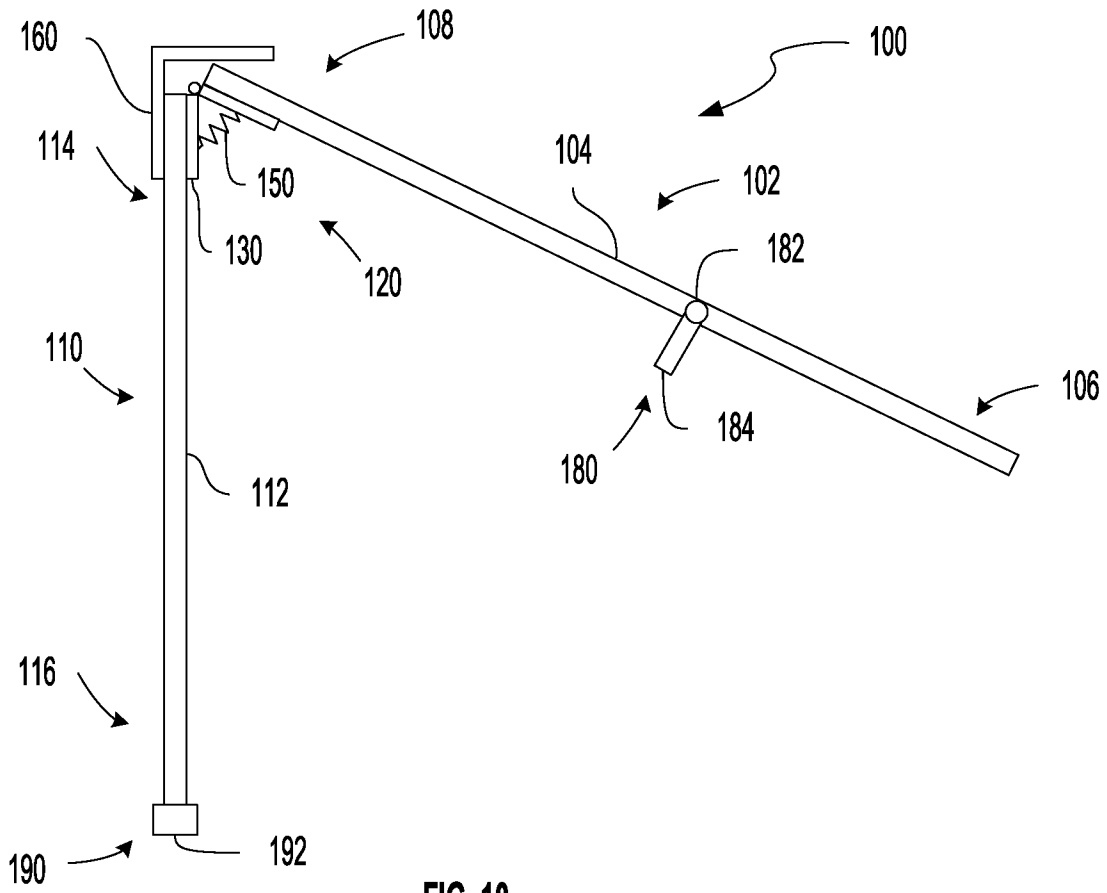
FIG. 10 is a side view of a multifunctional back tool, according to still another exemplary embodiment.
Figure 12:
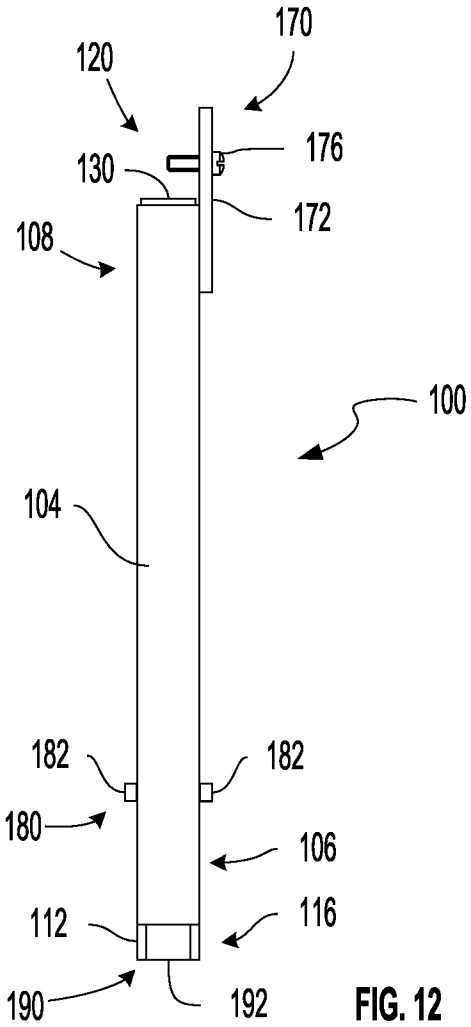
FIG. 12 is a front view of the multifunctional tool of FIG. 11, according to an exemplary embodiment.
Figure 11:
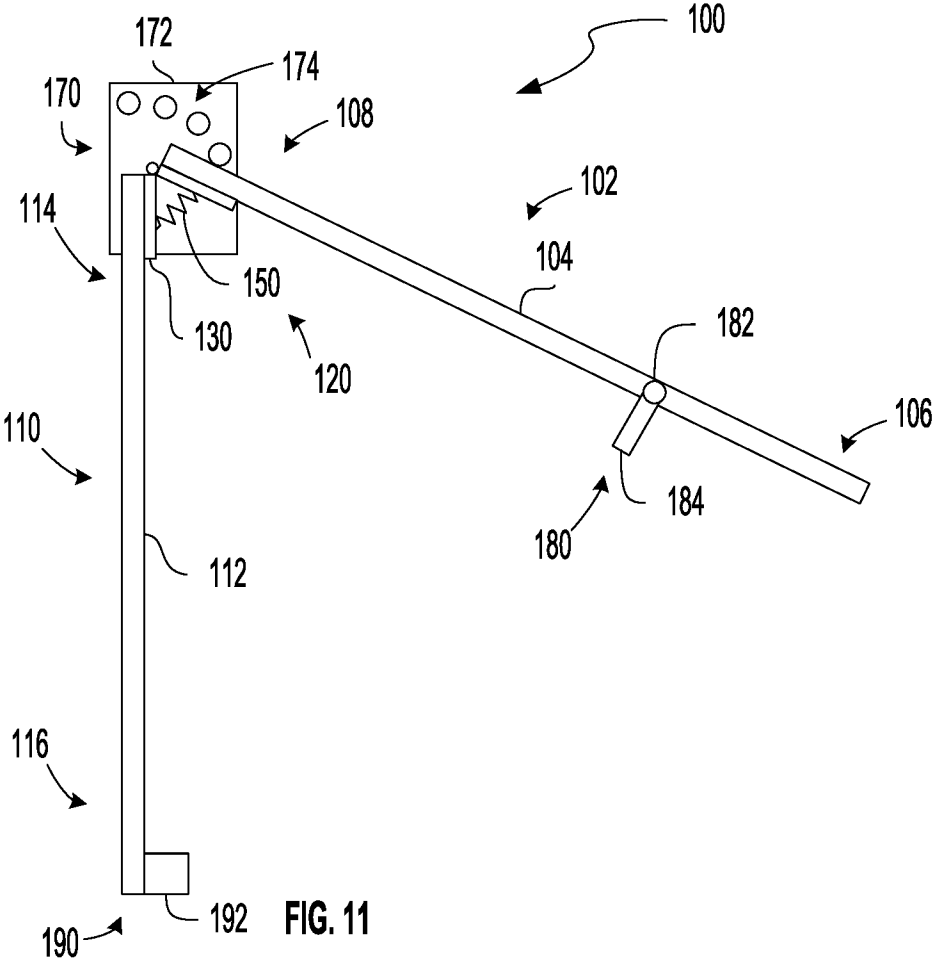
FIG. 11 is a side view of a multifunctional tool, according to yet another exemplary embodiment.

According to the exemplary embodiments shown in FIGS. 10-12, the joint 120 of the multifunctional tool 100 is configured as a self-opening hinge with a mechanical stop. As shown in FIG. 10, the joint 120 includes the hinge 130, a biasing element or energy storage device, shown as spring 150, and a mechanical stop (e.g., a retainer, a bracket, a brace, a plate, etc.), shown as retainer 160. In one embodiment, the spring 150 is a linear spring. In another embodiment, the spring 150 is a torsional spring. As shown in FIG. 10, the retainer 160 is coupled to the pivot end 114 of the arm shaft 112 and selectively engages with the pivot end 108 of the handle shaft 104. In another embodiment, the retainer 160 is coupled to the pivot end 108 of the handle shaft 104 and selectively engages with the pivot end 114 of the arm shaft 112. While the retainer 160 is shown to have a right angle profile, in some embodiments, the retainer 160 has another profile (e.g., a 135 degree profile, etc.). In some embodiments, the angle of the retainer 160 is adjustable (e.g., between 1 degree and 180 degrees) based on user preference. In some embodiments, the retainer 160 is configured to enclose the joint 120 to prevent objects from being pinched or damaged by the pivoting movement of the multifunctional tool 100. In another embodiment, the joint 120 includes a ratcheting mechanism to facilitate different opening angles.

According to an exemplary embodiment, the spring 150 is configured to bias the multifunctional tool 100 into the open position or orientation and the retainer 160 is positioned restrict and/or inhibit angular movement of the handle shaft 104 and the arm shaft 112 about the hinge 130 beyond a desirable angular offset (e.g., a fully-open position, an open position) from the closed position. For example, when the latch assembly 180 is disengaged, the multifunctional tool 100 is released from a loaded and/or closed position and the spring 150 biases or forces the multifunctional tool 100 to a fully open positon (e.g., 90 degrees, 135 degrees, etc.) where the retainer 160 stops rotation of the handle shaft 104 and the arm shaft 112 relative to each other. The fully open position may be the position at which the retainer 160 inhibits further pivoting of the handle shaft 104 and the arm shaft 112 relative to each other. To close the multifunctional tool 100, the user may need to supply a force to the handle shaft 104 and the arm shaft 112 to create a torque about the joint 120 that overcomes the biasing force of the spring 150. The force supplied by the user to close the multifunctional tool 100 may be stored in the spring 150 (e.g., as elastic potential energy) to provide the energy required to automatically open the multifunctional tool 100 upon releasing the latch assembly 180.

As shown in FIGS. 11 and 12, the joint 120 does not include the retainer 160, but instead the joint 120 includes an adjustable retainer assembly, shown as adjustment assembly 170. The adjustment assembly 170 includes (i) a plate, shown as adjustment plate 172, that defines a plurality of interfaces or apertures, shown as through-holes 174, and (ii) a retainer (e.g. a pin, a rod, a screw, a bolt, nut/bolt combination, a threaded rod, etc.), shown as retaining pin 176, that is selectively received by a respective one of the through-holes 174. As shown in FIGS. 11 and 12, the adjustment plate 172 is mounted to the multifunctional tool 100 such that the adjustment plate 172 is parallel to the plane in which the multifunctional tool 100 pivots. According to an exemplary embodiment, (i) the adjustment plate 172 is coupled to one of the pivot end 108 of the handle shaft 104 or the pivot end 114 of the arm shaft 112 such that (ii) the other of the pivot end 108 of the handle shaft 104 or the pivot end 114 of the arm shaft 112 is pivotable relative to the adjustment plate 172 about the hinge 130.

According to an exemplary embodiment, the through-holes 174 receive the retaining pin 176, which may function as a mechanical stop. The through-holes 174 may be tapped, threaded, or have a nut aligned therewith. In some embodiments, the pivot end 108 of the handle shaft 104 (or, alternatively, the pivot end 114 of the arm shaft 112) defines a channel or aperture than aligns with the through-holes 174 such that the retaining pin 176 extends though the handle shaft 104 and the adjustment plate 172 to secure the multifunctional tool 100 in a desired open position or orientation. In some embodiments, the joint 120 includes two adjustment plates 172 positioned on opposing sides of the joint 120. In such embodiments, the retaining pin 176 may extend through the first adjustment plate 172 and the second adjustment plate 172 to be equally supported about both ends thereof. In some embodiments, the retaining pin 176 extends from the first adjustment plate 172, through the handle shaft 104 (or the arm shaft 112), and to the second adjustment plate 172. In some embodiments, the retaining pin 176 is configured to interfere with the movement of the pivoting shaft without extending through the handle shaft 104 (or the arm shaft 112). In such embodiments, the movement of the pivoting shaft is restricted only beyond the fully open angle. The retaining pin 176 may be selectively repositionable between the through-holes 174 to selectively adjust the angle at which the multifunctional tool 100 opens to.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

It is important to note that the construction and arrangement of the multifunctional tool 100 and the components thereof as shown in the various exemplary embodiments is illustrative only. Additionally, any element disclosed in one embodiment may be incorporated or utilized with any other embodiment disclosed herein. For example, the features of the joint 120 (e.g., the hinge 130, the locking mechanism 140, the spring 150, the retainer 160, the adjustment assembly 170, etc.) may be used interchangeably or in combination.

The invention claimed is:

1. A tool comprising:

a handle having a first end and an opposing second end;

an arm having a third end and an opposing fourth end;

a pivotable coupler coupling the opposing second end of the handle to the third end of the arm, wherein the handle and the arm are pivotable relative to each other about the pivotable coupler between a closed orientation and an open orientation, wherein the handle and the arm extend in a substantially same direction when arranged in the closed orientation, and wherein the arm extends at an angle from the handle when arranged in the open orientation;

an implement coupled to the opposing fourth end of the arm; and a securing mechanism positioned along the handle and longitudinally spaced from the pivotable coupler, the securing mechanism configured to releasably secure the handle and the arm together in the closed orientation;

wherein the securing mechanism includes a latching arm pivotably coupled to the handle, the securing mechanism pivotable between a first position and a second position;

wherein the latching arm engages the arm in the first position to selectively secure the arm and the handle in the closed orientation;

wherein the securing mechanism selectively extends around the arm in the first position; and wherein the handle and the arm are configured to be selectively secured or held in the open orientation at the angle.

2. The tool of claim 1, wherein the pivotable coupler includes a biasing element positioned to bias the handle and the arm from the closed orientation into the open orientation in response to the securing mechanism being disengaged.

3. The tool of claim 2, further comprising a retainer positioned to prevent pivoting of the arm and the handle beyond the angle.

4. The tool of claim 3, wherein the angle is a fixed angle, and wherein the retainer has a fixed structure and prevents pivoting of the arm and the handle beyond the fixed angle.

5. The tool of claim 3, wherein the angle is a user-selected angle, and wherein the retainer is adjustable and prevents pivoting of the arm and the handle beyond the user-selected angle.

6. The tool of claim 5, wherein the retainer includes:

a retainer holder portion defining a plurality of apertures; and a retainer pin configured to be received by one of the plurality of apertures;

wherein the retainer pin prevents pivoting of the arm and the handle beyond the user-selected angle; and wherein the user-selected angle is adjustable by selectively repositioning the retainer pin to a different one of the plurality of apertures.

7. The tool of claim 1, further comprising an implement mount coupled to the opposing fourth end of the arm, the implement mount configured to detachably couple the implement to the arm.

8. The tool of claim 7, wherein the implement is a first implement, further comprising a second implement that is interchangeable with the first implement.

9. The tool of claim 8, wherein the second implement is different than the first implement.

10. The tool of claim 1, wherein the implement includes at least one of a scratcher attachment, a washcloth attachment, a lotion applicator attachment, a bath pouf attachment, a loofa attachment, a sponge attachment, a massager attachment, a light attachment, a hook attachment, a magnet attachment, a shoe horn attachment, a phone mount attachment, a light bulb gripper attachment, a duster head attachment, a brush head attachment, a broom head attachment, or a mop head attachment.

11. The tool of claim 1, wherein the angle is a first angle, and wherein the handle and the arm are configured to be selectively secured or held in the open orientation at a second angle different than the first angle.

12. The tool of claim 1, wherein a length of the handle is fixed.

13. The tool of claim 1, wherein a distance between the first end and the opposing second end defines a handle length, wherein a distance between the third end and the opposing fourth end defines an arm length, and wherein the arm length is greater than or equal to the handle length.

14. The tool of claim 1, wherein a length of the arm is fixed.

* * * * *